United States Patent [19]

Corey et al.

[11] 4,285,104

[45] Aug. 25, 1981

[54] FASTENER DEVICE

[75] Inventors: Joseph T. Corey; Thomas J. Corey, both of Williamsville, N.Y.

[73] Assignee: Permclip Products Corporation, Buffalo, N.Y.

[21] Appl. No.: 50,889

[22] Filed: Jun. 21, 1979

[51] Int. Cl.[3] ..... A44B 9/00

[52] U.S. Cl. ..... 24/153; 248/205 A

[58] Field of Search ..... 24/153 R, 153.1, 153.3 P; 248/205 A; 402/15

[56] References Cited

U.S. PATENT DOCUMENTS

| | | | |
|---|---|---|---|
| 752,402 | 2/1904 | Lawson | 24/153 R |
| 1,495,202 | 5/1924 | Riddell | 24/153 R X |
| 3,074,133 | 1/1963 | Jones | 24/153 X |
| 3,271,829 | 9/1966 | Corey | 28/153 R X |
| 3,458,946 | 8/1969 | Lasswell | 248/205 A X |
| 3,641,632 | 2/1972 | Corey | 24/153 R |
| 3,741,385 | 6/1973 | Corey | 24/153 R X |
| 3,782,388 | 1/1974 | Page | 248/205 A X |
| 3,867,743 | 2/1975 | Corey | 24/153 R |
| 4,122,857 | 10/1978 | Haerr | 248/205 A X |

*Primary Examiner*—Roy D. Frazier
*Assistant Examiner*—Peter A. Aschenbrenner
*Attorney, Agent, or Firm*—Joseph P. Gastel

[57] ABSTRACT

A fastener device including a flexible resilient base member of foam-like material having an upper side and a lower side, a prong member having a central portion and outer end portions, an overlay member covering the central portion of the prong member with the central portion and the overlay member being adhesively secured by pressure-sensitive adhesive to the upper side of the base member, a pair of spaced apertures in the overlya member through which the outer end portions of the prong member extend, and pressure-sensitive adhesive on the lower side of the base member for securing it to another member.

11 Claims, 7 Drawing Figures

FASTENER DEVICE

BACKGROUND OF THE INVENTION

The present invention relates to a fastener device for holding papers or the like on a leaf of a file folder or the like.

By way of background, there are a number of fastener devices known in the art which include an overlay member which secures a prong member to a file folder. Devices of this type are shown in U.S. Pat. Nos. 3,271,829, 3,641,632, 3,741,385 and 3,867,743. Devices of this type required an overlay member to be secured to the leaf of a file folder or the like by hot melt adhesive which was unusually strong. This prevented the fastener devices from being mounted on file folders by individuals who did not have the proper equipment to activate the hot melt adhesive. Attempts were made to affix fastener devices directly to file folders by means of pressure-sensitive adhesive. However, these attempts were not commercially acceptable because of the fact that the adhesive was applied directly to the central portion of the prong member or to a two-sided tape with no cushioning qualities and it tended to pull away from the file folder either because of the shock to which it was subjected in use and/or because of the "memory" of the prong member, when curved, which exerted a continual force on the adhesive until the bond was broken. It is with overcoming the foregoing deficiencies of the prior art that the present invention is concerned.

SUMMARY OF THE INVENTION

It is the object of the present invention to provide an improved fastener device which can be secured to a file folder leaf or the like by pressure-sensitive adhesive in a commercially acceptable manner so that there is no separation from the file folder due to the normal forces to which the fastener device is subjected to in use. Other objects and attendant advantages of the present invention will readily be perceived hereafter.

The present invention relates to a fastener device comprising a flexible resilient base member having an upper side and a lower side, a prong member having a central portion and outer end portions, first means on said upper side for securing said central portion to said base member, and pressure-sensitive adhesive on said lower side for securing said base member to another member. The present invention will be more fully understood when the following portions of the specification are read in conjunction with the accompanying drawings wherein:

BRIEF DESCRIPTION OF THE DRAWINGS

FIG. 1 is a perspective view of the improved fastener device showing the upper portion thereof;

FIG. 2 is a perspective view of the improved fastener device turned over so as to show the underside thereof;

FIG. 3 is a cross sectional view taken substantially along line 3—3 of FIG. 1;

FIG. 4 is an enlarged fragmentary view of the area designated FIG. 4 in FIG. 3;

FIG. 5 is a fragmentary perspective view of the improved fastener device attached to a leaf of a file folder or the like;

FIG. 6 is a fragmentary cross sectional view taken substantially along line 6—6 of FIG. 5; and FIG. 7 is a cross sectional view similar to FIG. 6 but showing a prior art fastener device.

DESCRIPTION OF THE PREFERRED EMBODIMENTS

Figures 1, 2, 3, 4, 5, 6, 7:
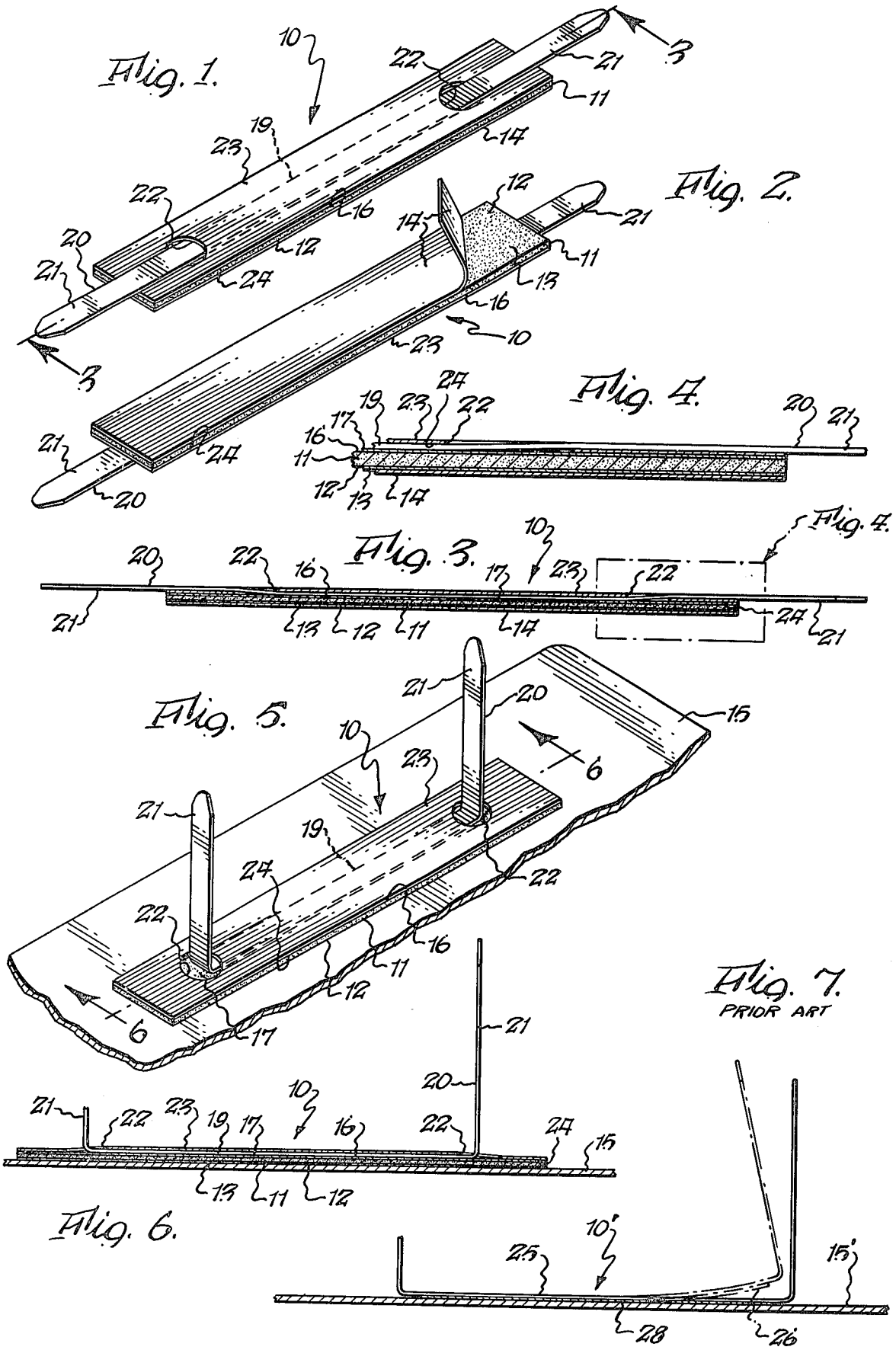
Fig. 7. PRIOR ART

The improved fastener device 10 includes a base member 11 of flexible resilient foam-like material which may be made of any suitable substance, such as polyethylene, polyurethane, or polypropylene. However, it is believed that other resilient flexible materials may be used, whether or not they are foam-like, provided they possess the required resilience and flexibility. The underside 12 of member 11 is coated with a layer of suitable pressure-sensitive adhesive 13 and this layer is covered by a paper strip 14 which is peeled from adhesive 13 prior to affixing fastener device 10 to the leaf 15 of a file folder or the like. The upper side 16 of base member 11 has a layer of adhesive 17 thereon, which may be pressure-sensitive. The central portion 19 of prong member 20 has its underside in contact with adhesive 17 and the end portions 21 of prong member 20 extend through apertures 22 in overlay member 23 which has its undersurface 24 secured to adhesive 17. Thus, the central portion 19 of prong member 20 is not only adhesively secured to base member 11, but it is also held in position by overlay member 23 which is adhesively secured to base member 11.

In use, after cover strip 14 has been peeled from undersurface 12, adhesive 13 causes the fastener device to stick to leaf member 15. The end portions 21 of prong member 20 are turned up, as shown in FIG. 5, and paper having holes punched therein the same distance apart as apertures 22 are mounted on end portions 21 by inserting these end portions through the punched holes. Thereafter, end portions 21 are bent downwardly, either to the position shown in FIG. 1, or toward each other to hold the papers in position.

During the mounting and demounting of papers onto fastener device 10, it experiences great amount of stress which might either pull undersurface 12 away from leaf 15, or might possibly pull prong member 20 away from base member 11. However, the possibility of this occurrence is extremely remote because base member 11 has an inherent shock absorbing capability because of its flexibility and resilience which effectively prevents overlay member 23 from being pulled away from base member 11 and also prevents base member 11 from being pulled away from leaf 15. It is believed that the reason that this separation does not take place is because of the flexibility and resilience of base member 11 which permits it to stretch or distort to accommodate external forces applied thereto and after such forces are removed, base member 11 will tend to return to its original configuration, or else remain in stretched condition without pulling away from leaf 15 or permitting the central portion 19 of prong member 20 or overlay member 23 from pulling away from base member 11. It is to be especially noted that the excellent adherence between undersurface 12 and leaf 15 is due also to the fact that there are no gaps between the adhesive and the leaf 15, so that base member 11 does not tend to peel away. In addition, the fact that both the central portion of prong member 20 and overlay member 23 are adhesively secured to base member 11 enhances the retention of prong member 20 on base member 11.

The foregoing can be more fully understood when a prior art prong member 10' is analyzed relative to the leaf 15' on which it is mounted. This prior art prong member does not have a flexible resilient base 11. The pressure-sensitive adhesive 28 is coated onto central portion 25 of the fastener device and theoretically the fastener device 10' should occupy the solid-line position in FIG. 6. However, the prong member 10' has a certain inherent "memory" due to the fabrication process to which it was subjected. This memory will tend to cause it to assume the dotted-line position shown in FIG. 7 and in doing so it will exert a continual force on the adhesive layer 24 which will eventually cause separation at the area 26. Once there has been a certain amount of separation, the bond between prong member 10' and leaf 15' becomes weaker and eventually the prong member 10' will pull away completely from leaf 15'. It can readily be seen that this would not happen with fastener device 10 because if there is any inherent memory in either the prong member 20 or in leaf 15 or in overlay 23, the base member 11 will stretch to accommodate the memory. Thus, there will be no area at which base member 11 pulls away from leaf 15 or where overlay 23 pulls away from base member 11 or where central portion 19 of prong member 20 pulls away from base member 11. Furthermore, fastener 10' cannot absorb normal shocks encountered in usage without pulling away, as shown in FIG. 7.

By way of dimensions, fastener devices 10 have been fabricated in a rectangular shape $\frac{5}{8}''$ wide and 4" long. The apertures 22 are centered $2\frac{3}{4}''$ apart and base member 11 is approximately 1/32" thick. The overlay member 23 can be any nonwoven fabric or other planar sheet material, such as the material known under the trademark Mylar which is between 0.012 and 0.015 inches thick.

While a preferred embodiment of the present invention has been disclosed, it will be appreciated that it is not limited thereto but may be otherwise embodied within the scope of the following claims.

What is claimed is:

1. A fastener device for holding papers on the leaf of a file folder comprising base means for attachment to the leaf of a file folder and having an upper side and a lower side, a prong member having a central portion and outer end portions on which said papers are mounted and demounted, securing means on said upper side for securing said central portion to said base means, and pressure-sensitive adhesive on said lower side for securing said base means to said leaf of said file folder, said base means being flexible and resilient so as to be capable of being stretched by forces applied to said prong member during mounting and demounting of said papers to thereby absorb said forces while retaining adhesive engagement with said leaf to tend to prevent said base means from being pulled away from said leaf.

2. A fastener device as set forth in claim 1 wherein said securing means includes adhesive on said upper side.

3. A fastener device as set forth in claim 2 wherein said securing means includes an overlay member covering said central portion and adhesively secured to said upper side, and wherein said central portion is positioned between said upper side of said base means and said overlay member.

4. A fastener device as set forth in claim 3 wherein said overlay member includes an upper side and a lower side, a pair of spaced apertures in said overlay member, and wherein said end portions extend through said apertures and are disposed above said upper side of said overlay member.

5. A fastener device as set forth in claim 4 wherein said securing means comprises pressure-sensitive adhesive.

6. A fastener device as set forth in claim 1 wherein said base means comprises foam-like material.

7. A fastener device as set forth in claim 6 wherein said securing means includes an overlay member covering said central portion and adhesively secured to said upper side, and wherein said central portion is positioned between said upper side of said base means and said overlay member.

8. A fastener device as set forth in claim 7 wherein said securing means comprises pressure-sensitive adhesive.

9. A fastener device as set forth in claim 8 wherein said overlay member includes an upper side and a lower side, a pair of spaced apertures in said overlay member, and wherein said end portions extend through said apertures and are disposed above said upper side of said overlay member.

10. A fastener device for holding papers on the leaf of a file folder comprising base means for attachment to the leaf of a file folder and having an upper side and a lower side, a prong member having a central portion and outer end portions on which said papers are mounted and demounted, securing means on said upper side for securing said central portion to said base means, and adhesive means on said lower side for securing said base means to said leaf of said file folder, said base means being flexible and resilient so as to be capable of being stretched by forces applied to said prong member during mounting and demounting of said papers to thereby absorb said forces while retaining adhesive engagement with said leaf to tend to prevent said base means from being pulled away from said leaf.

11. A fastener device as set forth in claim 10 wherein said base member comprises foam-like material.

* * * * *